US007173506B2

(12) United States Patent
Ross, Jr.

(10) Patent No.: US 7,173,506 B2
(45) Date of Patent: Feb. 6, 2007

(54) DIAL ASSEMBLY WITH MAGNETICALLY BIASED REED SWITCH

(75) Inventor: Herbert G. Ross, Jr., Argyle, TX (US)

(73) Assignee: Rochester Gauges, Inc., Dallas, TX (US)

( * ) Notice: Subject to any disclaimer, the term of this patent is extended or adjusted under 35 U.S.C. 154(b) by 84 days.

(21) Appl. No.: 10/715,660

(22) Filed: Nov. 18, 2003

(65) Prior Publication Data

US 2004/0212468 A1 Oct. 28, 2004

Related U.S. Application Data

(60) Provisional application No. 60/465,839, filed on Apr. 25, 2003.

(51) Int. Cl.
*H01H 9/00* (2006.01)

(52) U.S. Cl. ..... 335/207; 335/205

(58) Field of Classification Search ..... 335/205–207
See application file for complete search history.

(56) References Cited

U.S. PATENT DOCUMENTS 3,806,851 A * 4/1974 McCormick ..... 335/205
3,859,651 A * 1/1975 Thomas, Jr. ..... 340/870.09
4,567,763 A * 2/1986 Schiffbauer ..... 73/866.1
4,943,791 A * 7/1990 Holce et al. ..... 335/153
4,987,400 A 1/1991 Fekete ..... 338/164
5,438,869 A * 8/1995 Mueller et al. ..... 73/431
6,089,086 A * 7/2000 Swindler et al. ..... 73/317
6,479,981 B2 11/2002 Schweitzer, Jr. et al. ... 324/133
2002/0088278 A1 7/2002 Ross, Jr. ..... 73/290 R

* cited by examiner

*Primary Examiner*—Elvin Enad
*Assistant Examiner*—Bernard Rojas
(74) *Attorney, Agent, or Firm*—Howison & Arnott, L.L.P.

(57) ABSTRACT

A dial assembly for a magnetically driven gauge. The dial assembly, including a rotatable dial magnet, a reed switch and a bias magnet. The bias magnet and reed switch being positioned such that when the poles of the bias magnet and the dial magnet are in a first orientation the reed switch be held in a first position (such as a closed contact position) and that when the dial magnet rotates to a second position such that the poles of the dial magnet and bias magnet are in a second orientation, the reed switch will be held at a second orientation (such as an open, non-contact orientation).

12 Claims, 3 Drawing Sheets

DIAL ASSEMBLY WITH MAGNETICALLY BIASED REED SWITCH

PRIORITY

Applicant claims priority to provisional application Ser. No. 60/465,839 filed Apr. 25, 2003, entitled "Dail Assembly with Magnetically Biased Reed Switch".

TECHNICAL FIELD

The present invention relates to dial assemblies for use with magnetically driven gauges and, in particular, a magnetically biased reed switch for indicating a certain liquid level.

BACKGROUND OF THE INVENTION

Magnetically driven gauges are commonly utilized in measuring the liquid level of liquified compressed gases such as LP gas. These types of gauges are commonly employed in pressure vessels. The gauge assembly typically has two parts, one being a float assembly and the other being a dial assembly. The float assembly generally comprises a float which moves in response to changes in liquid level. The float assembly has a gauge head for attaching to the vessel. As the float moves in response to changes in liquid levels, the tank magnet of the float assembly rotates corresponding to changes in the float position. The gauge head seals the float assembly from the outside environment. The separate dial assembly is used in connection with the float assembly. The dial assembly is mounted on the outside of the gauge head and positioned such that it is operatively adjacent to the tank magnet. The dial assembly typically has a back with a pivot pin, and a dial magnet which is rotatable about the pivot pin. When the dial assembly is mounted on the gauge head, it is positioned such that the tank magnet and dial magnet are magnetically coupled. Thus, as the tank magnet rotates it will cause a corresponding rotation of the dial magnet. The dial magnet can include a pointer either as a part of the magnet or as a separate piece. The pointer can then be used in combination with indicia on the dial face to provide a visual indication of the liquid level in the tank to the user.

One disadvantage of these gauges is that the tank may be located where the dial is not conveniently observed by the operator. To address that disadvantage, dial assemblies have been used which include a resistive element in order to provide a continuous and instantaneous transmission of a signal representing the tank level to a location remote from the tank that is more easily viewed by the user. Such a dial assembly is illustrated in U.S. Pat. No. 4,987,400. These dial assemblies have a disadvantage in that they are costly to construct and require circuitry to match the output with the remote gauge.

There has been a continuing need for a low cost remote indicator of the fluid level in such a vessel. In many applications, it is not necessary to have a readily visible indication of liquid level available to the operator. What is desirable, however, is an indication of low liquid level so that the operator may refuel before exhausting the fuel supply. The present invention provides a dial assembly which may be used with existing float assemblies to provide a remote indication that the fuel is low and refueling is appropriate. The present invention has the advantage of being easy to construct, requires little sophisticated circuitry to implement and can be retrofitted on many existing float assemblies.

SUMMARY OF THE INVENTION

In one aspect, the present invention relates to the dial assembly for use in a magnetically driven gauge. The assembly includes a first member which has a pivot pin extending therefrom, a dial magnet which is rotatable about the pivot pin, and a reed switch assembly positioned operatively adjacent to the dial magnet. The second member is provided to cooperate with the first member to form a housing for the dial magnet. The reed switch assembly includes a reed switch, a bias magnet, and electrical leads to the reed switch. In addition, the reed switch assembly may be integral with the dial assembly or may be a separate unit which is attachable to the housing of the dial assembly. The bias magnet functions to hold the two reeds of the reed switch in contact, thereby allowing the reed switch to form an electrical path. The reed switch assembly and the dial magnet are positioned operatively adjacent to one another. In operation, when the reed switch is in a first orientation (for example, the closed orientation where the reeds are in contact), the poles of the dial magnet are also in a first orientation. Preferably, the poles of the dial magnet are on opposite sides of the pivot pin and rotate about the pivot pin. In the first orientation, which may be the reed switch closed orientation, the dial magnet can be rotated through an arc in which the reed switch will remain closed. Any position on this arc would be a first orientation position of the dial magnet. The reed switch is held in a second orientation (an open switch where the reeds are not in contact) when the dial magnet is in a second orientation. The second orientation of the dial magnet would be any position in the arc of rotation of the dial magnet in which the reed switch remains open. Thus, the invention allows one pole of the dial magnet to pass by the reed switch without causing the reed switch to open, and to cause the reed switch to open when the other pole of the dial magnet passes by the reed switch. Thus, the invention allows for a construction of the dial assembly having a reed switch assembly wherein the dial magnet can rotate more than 180° but only cause the reed switch to change orientation when only one of the dial magnet poles pass nearby. Passage of the other poles of the dial magnet does not cause the reed switch to change orientation.

In a preferred embodiment of the present invention, the first member of the dial assembly forms a base. Extending from the first member is the pivot pin. Rotatably mounted about the pivot pin is a dial magnet. The dial magnet may either include a pointer as part of the magnet or be attached to a pointer assembly. Mounted between the pointer and the first member is a dial face bearing indicia of liquid level. A second member forms a cover over the dial magnet and pointer. The cover may include as an integral part, the reed switch assembly. In another preferred embodiment, the cover may define a receptacle for receiving a reed switch assembly. In one embodiment, the cover may include a receptacle into which the reed switch assembly can be received. The reed switch can be held in position by friction fit, mechanical means, or by adhesive. Alternatively, the cover can provide a projection onto which the reed switch may be mounted by friction fit, mechanical means, or adhesive.

BRIEF DESCRIPTION OF THE DRAWINGS

A more complete understanding of the invention can be had by referring to the following detailed description, together with the accompanying drawings wherein.

DETAILED DESCRIPTION

Figure 1:
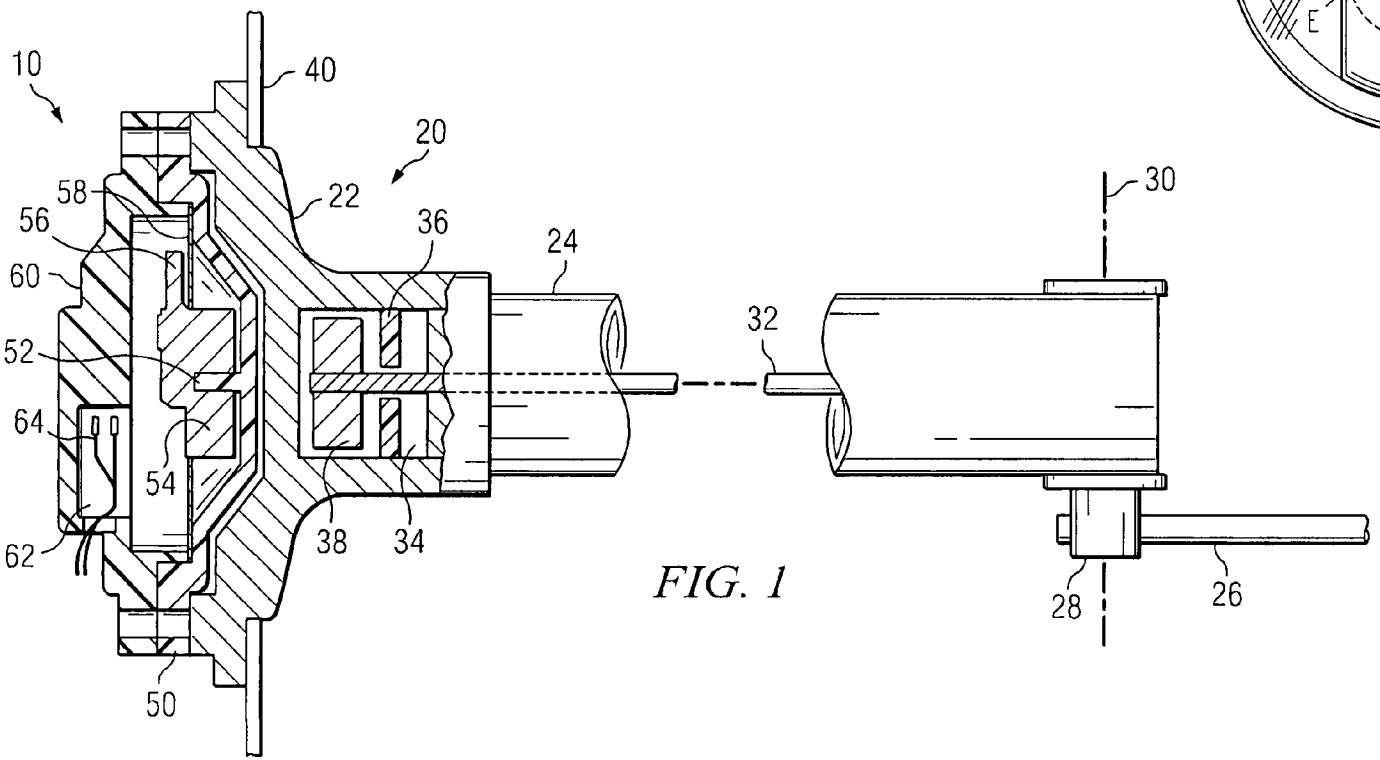
FIG. 1 is a cross sectional view of the present invention together with a partial cross sectional view of a typical gauge assembly.

Referring now to the drawings, wherein like reference numerals designate like or corresponding parts throughout the several views, there is illustrated in FIG. 1 a dial assembly 10 of the present invention which is mounted on gauge assembly 20. Gauge assembly 20 includes gauge head 22 and attached to gauge head 22 is support member 24. Attached to the end of the support member 24 opposite gauge head 22 is float arm 26. Float arm 26 is connected to shaft 28 which is rotatable about axis 30. A mechanical gear linkage (not shown) as is know in the art connects shaft 28 to transmitting shaft 32. Transmitting shaft 32 is rotatably mounted in the gauge assembly 20 and is rotatable in gauge head 22 and support member 24. Gauge head 22 defines a passageway 34 which receives the transmitting shaft 32 and can include bushing 36 in which transmitting shaft 32 rotates. Attached to the end of transmitting shaft 32 opposite the end of the shaft linked to float arm 26 is tank magnet 38. As liquid level in the vessel changes the float (not shown) will cause the float arm 26 to move and through mechanical linkage cause rotation of transmitting shaft 32. This will in turn cause tank magnet 38 to rotate. Gauge head 20 is mounted on tank wall 40 shown only partially.

Dial assembly 10 has a back member 50. Extending from back member 50 is pivot pin 52. Rotatably mounted on pivot pin 52 is dial magnet 54, either as part of dial magnet 54 or as a separate attachment is pointer 56. Also attached to the back, is dial face 58 which is marked with indicia indicating various tank levels. Attached to back member 50 is cover member 60. Cover member 60 defines a receptacle 62 to receive reed switch assembly 64. In one embodiment, the reed switch assembly 64 can be an integral part of the cover member 60. Alternatively, it can be a separate unit which is attached to cover member 60. The pivot pin can be attached to cover member rather than to the member back.

Figure 2:
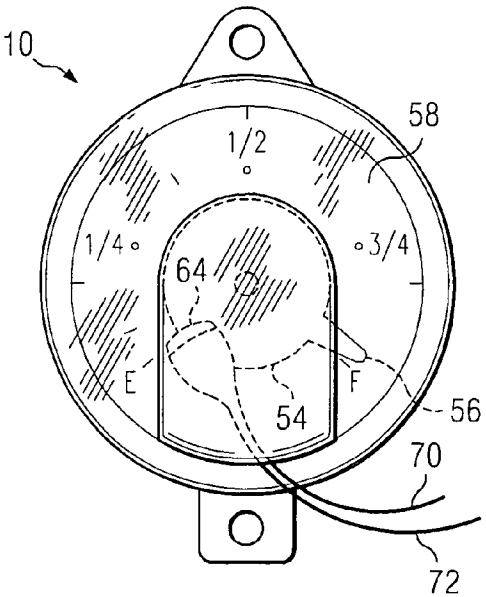
FIG. 2 is a frontal view of the dial assembly.

FIG. 2 is a front view of the dial assembly 10. As can be seen, dial face 58 bears indicia of liquid level. Shown in phantom is dial magnet 54. Connected to the reed switch assembly 64 (shown in phantom) and extending from the dial assembly 10 are two electrical leads 70 and 72 for connection to appropriate circuitry.

Figure 3:
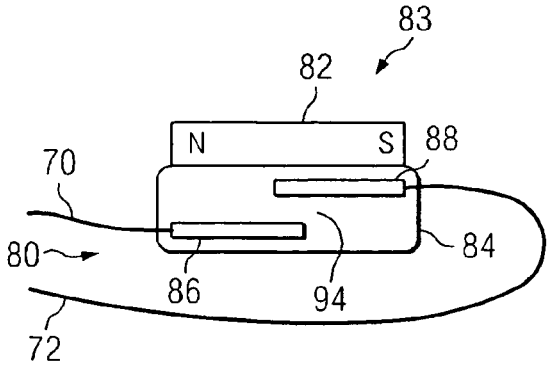
FIG. 3 is a schematic representation of the reed switch assembly shown at cross section.
Figure 4:
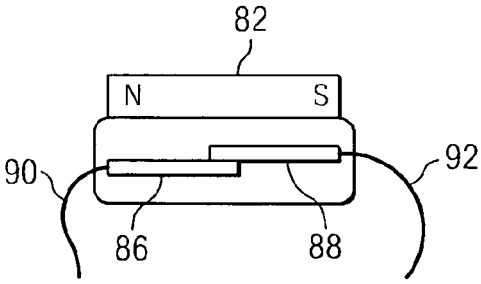
FIG. 4 is a schematic cross section of the reed switch showing the switch in the closed position.

FIG. 3 illustrates the reed switch 80 attached to a bias magnet 82 and leads 70 and 72 to form a reed switch assembly 83. Reed switch 80 has a housing 84 which contains a first reed 86 and a second reed 88. Each reed is connected to a corresponding first and second electrical lead 70 and 72. Illustrated in FIG. 3 is a gap 94 between first reed 86 and second reed 88. This shows an open switch, i.e., electrical circuit will not be completed because the reeds are not in contact. In the preferred embodiment of the present invention, when the bias magnet 82 is positioned next to the reed switch 80, the switch is biased closed such that reeds 86 and 88 are in contact as show in FIG. 4.

Figure 4A:
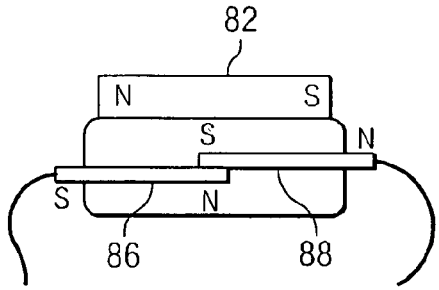
FIG. 4A shows the induced magnetic field in the reed switch when not influenced by the dial magnet.
Figure 5:
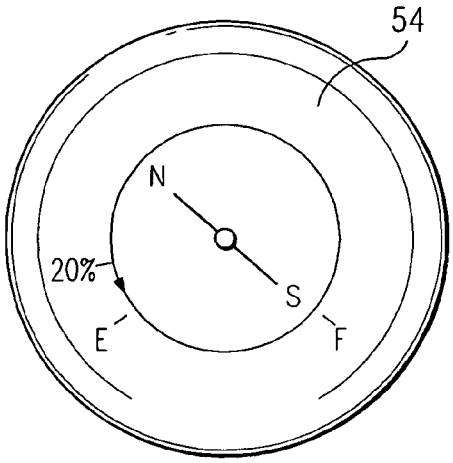
FIG. 5 is a schematic representation showing rotation of the dial magnetic poles about the face indicia.

FIG. 4A illustrates the bias magnet 82 with a north and south pole. In the absence of other magnet fields, a bias magnet induces the attraction of the two reeds 86 and 88 by inducing a south and north pole in reed 86 and a south and north pole in reed 88 such that the two free ends of the reeds are drawn together to make contact. The bias magnet 82 places the reed switch 80 in a closed position. As can be seen in FIG. 2, in these dial assemblies the pointer will generally rotate approximately 270° from the full to empty positions. Thus, if one positioned a reed switch at the 20% full tank position, the north, or non-pointer, end of the dial magnet 54 would pass by the reed switch before the pointer end 56 did. It is desirable that the reed switch not be tripped by the non-pointer end of the dial magnet 54, yet be tripped by the pointer 56. As shown in FIG. 5, if the north pole of the dial magnet 54 corresponded to a full indication on a dial face and a reed switch without a bias magnet was positioned at the 20% mark, the reed switch would close when the south pole of the magnet came close to the switch, closing the switch. If the reed switch were connected to a circuit which when the switch closed illuminated a light, the light would come on not when the tank was 20% full, but when it was close to 100% full. As the dial magnet 54 rotates further, the switch will open and then close again when the north pole draws close. In the invention, the bias magnet will function such that the reed switch will not be activated by the passing of one of the magnetic poles of the dial magnet, but will be activated when the other magnet pole becomes properly aligned.

Figure 6:
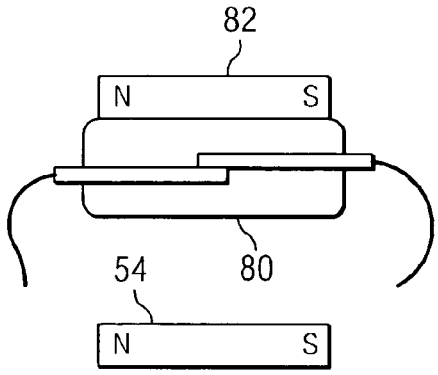
FIG. 6 is a schematic representation showing the reed switch assembly in a closed position and the influence the aligned dial magnet pulls showing that the reed switch remains closed in this orientation.

Referring now to FIG. 6, the reed switch 80 with bias magnet 82 is positioned over a portion of the dial magnet such that the north pole of the bias magnet 82 is aligned over the north pole of the dial magnet 54, and the south pole of the bias magnet 82 is over the south pole of dial magnet 54. For ease of illustration, FIG. 6 shows the bias magnet positioned over the entire length of the dial magnet, but it is not necessary for the bias magnet to be long enough to be able to extend over both poles of the dial magnet.

Figure 7:
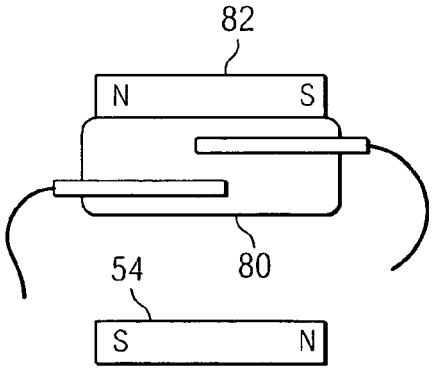
FIG. 7 is a schematic representation of the orientation of the bias magnet pulls and the dial magnet pulls so as to induce the reed switch to be in the open position.

The reed switch and bias magnet can extend across the full diameter of the dial magnet or only a portion of the dial magnet. When the north and south poles of each magnet are properly oriented to each other, the reed switch is held closed by the magnetic field. Thus, even though one magnetic pole passes under the reed switch, the reed switch will not be activated because the two magnets will not be properly aligned so as to open the reed switch. FIG. 7 shows that when the north pole of the bias magnet 82 is over the south pole of the dial magnet 54 the reed switch is opened.

Figure 8:
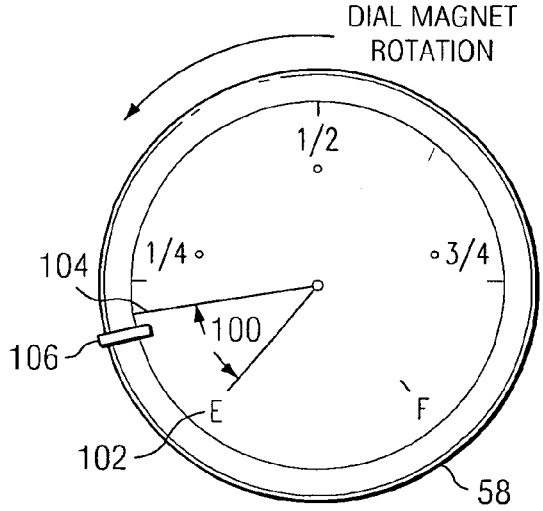
FIG. 8 is a schematic representation showing the dial face and a mark of rotation through which the reed switch assembly is held in one orientation.

It will be appreciated that there will be some hysteresis such that the reed switch will be open when the desired magnetic pole of dial magnet 54 travels through a certain arc. In other words, on each side of the alignment of the appropriate poles, the switch will remain open within a certain radial arc of travel of the pole on the dial magnet. The hysteresis can be used such that the dial magnet and reed switch can be positioned such so the reed switch remains open between the opening point on the arc and the empty stop. Referring to FIG. 8, illustrated is dial face 58 with an arc 100 drawn. One of the magnetic poles of dial magnet would be aligned in the center of arc 100. On each end 102 and 104 of the arc 100 the magnetic strength of the dial magnet is sufficient to allow the reed switch to open. Thus, as the dial magnet rotates from the full position, the reed switch assembly 106 will open when first end 102 of arc 100 passes under the reed switch assembly 106. This will open the switch, and when a normally closed to open circuit is provided, the opening of the reed switch can cause activation of a level warning signal. The level warning signal could be an illuminated light or a sound from a device, or other signal or combination of signals.

A number of factors can affect the opening and closing of the reed switch and the length of the arc over which the switch will remain open. These factors include the shape of each magnet, the strength of each magnet, and the distance of each magnet from the reed switch. Each of these variables can be selected to affect the desired opening of the reed switch and to some extent the length of the arc over which the reed switch will remain open. The present invention can be used with well known dial magnets as shown in U.S. Pat. No. 4,987,400 or with shaped style magnets as shown in Published U.S. application Ser. No. 20020088278, Liquid Level gauge with Removable Hall Device.

The leads 70 and 72 from the reed switch assembly are hooked to an appropriate circuit. This circuit can be constructed so that an indicator light will be illuminated when the contacts of the reed switch are in the open (non contact) positions. As is known in the art the circuit can be constructed such that the light would be illuminated when the reed switch was normally opened or illuminated when the reed switch was normally closed as desired.

Figure 9:
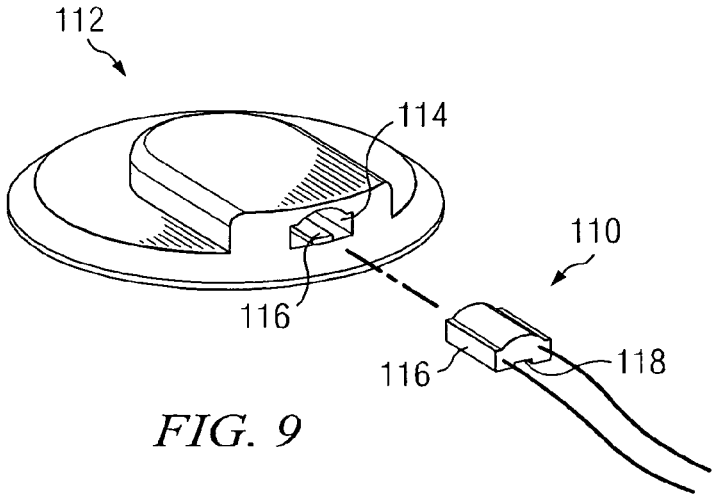
FIG. 9 illustrates a perspective view of a dial cover having a receptacle to receive a reed switch assembly.

In a preferred embodiment of the present invention illustrated in FIG. 9, the reed switch assembly 110 is a separate unit from the cover member 112. As shown in FIG. 9, the dial cover 112 defines an opening 114 for receipt of the reed switch assembly 110. The reed switch assembly 110 includes a carrier 116 dimensioned to be received within the receptacle 114 on the cover member 112 and contains the reed switch and magnet (not shown). If desired, it may also contain circuit components. The reed switch assembly 116 can be held in place by friction fit, an adhesive, by providing a tab 116 on the cover member 112 and a detent 118 (shown in phantom) on the carrier 116. As will be appreciated the method of attachment of the reed switch assembly 110 can be reversed, for example, the cover could be provided with a projection that could be received within a receptacle on the reed switch assembly. Thus, any means to attach the reed switch assembly to the cover which positions the reed switch assembly operatively adjacent to the dial magnet is appropriate.

Thus, the present invention provides an assembly in which the reed switch will be in a closed position when one pole of the dial magnet is in a first orientation on each side of said pole. The reed switch remains closed as the dial magnet travels outside said first orientation.

Although several embodiments of the invention have been illustrated in the accompanying drawings and described in the foregoing detailed description, it is understood that the invention is not limited to the embodiments disclosed, but is capable of numerous rearrangements, modifications or substitution of parts and elements without departing from the invention.

What is claimed is:

1. A gauge comprising:

(a) a gauge assembly having (i) a gauge head;

(ii) a support member extending from said gauge head;

(iii) a transmitting shaft having a first end and a second end rotatable in said support member;

(iv) a tank magnet attached to said first end of said transmitting shaft;

(v) a float arm linked to said transmitting shaft such that movement of said float arm results in rotation of said transmitting shaft;

(b) a dial assembly mounted on said gauge assembly having:

(i) a first member having a pivot pin attached thereto;

(ii) a dial magnet in magnetic &communication with said tank magnet and which is rotatably mounted on said pivot pin;

(iii) a reed switch assembly positioned operatively adjacent to said dial magnet comprising:

(iv) a reed switch; and (v) a bias magnet positioned such that said reed switch is held in the first position when the poles of said dial and bias magnets are in a first orientation and will be held in a second position when the poles of the dial magnet and bias magnet are in a second orientation.

2. A dial assembly of claim 1 further comprising a cover defining a receptacle for receiving said reed switch assembly.

3. A dial assembly of claim 1 wherein in said first position of said reed switch the reeds of said reed switch are in contact.

4. A dial assembly of claim 1 wherein in said first position of said reed switch the reeds of said reed switch are in contact.

5. A gauge comprising:

a gauge assembly having:

(i) means for detecting an amount of a substance in a vessel;

(ii) means for generating a signal proportional to said amount of substance in said vessel;

(iii) a tank magnet for transmitting said signal to a dial assembly;

wherein said dial assembly comprises:

(i) a first member having a pivot pin attached thereto;

(ii) a dial magnet in magnetic communication with said tank magnet and which is rotatably mounted on said pivot pin;

(iii) a reed switch assembly positioned operatively adjacent to said dial magnet comprising:

(iv) a reed switch; and (v) a bias magnet positioned such that said reed switch is held in the first position when the poles of said dial and bias magnets are in a first orientation and will be held in a second position when the poles of the dial magnet and bias magnet are in a second orientation.

6. A gauge of claim 5 further comprising a cover defining a receptacle for receiving said reed switch assembly.

7. A gauge of claim 5 wherein in said first position of said reed switch the reeds of said reed switch are in contact.

8. A gauge of claim 5 wherein in said first position of said reed switch the reeds of said reed switch are in contact.

9. A gauge comprising:

a gauge assembly having:

(i) a float for detecting an amount of a fluid in a vessel;

(ii) a transmitting shaft having a first end and a second end, wherein said second end is attached to said float such that movement of said float results in rotation of said transmitting shaft;

(iii) a tank magnet attached to said first end of said transmitting shaft;

a dial assembly comprising:

(i) a first member having a pivot pin attached thereto;

(ii) a dial magnet in magnetic communication with said tank magnet and which is rotatably mounted on said pivot pin;

(iii) a reed switch assembly positioned operatively adjacent to said dial magnet comprising:

(iv) a reed switch; and (v) a bias magnet positioned such that said reed switch is held in the first position when the poles of said dial and bias magnets are in a first orientation and will be held in a second position when the poles of the dial magnet and bias magnet are in a second orientation.

10. A gauge of claim 9 further comprising a cover defining a receptacle for receiving said reed switch assembly.

11. A gauge assembly of claim 9 wherein in said first position of said reed switch the reeds of said reed switch are in contact.

12. A gauge assembly of claim 9 wherein in said first position of said reed switch the reeds of said reed switch are in contact.

* * * * *